US010697442B2

(12) United States Patent
Bonnard et al.

(10) Patent No.: US 10,697,442 B2
(45) Date of Patent: Jun. 30, 2020

(54) HYDRAULIC MACHINE HAVING TWO CYLINDER CAPACITIES AND A SAFETY VALVE

(71) Applicant: POCLAIN HYDRAULICS INDUSTRIE, Verberie (FR)

(72) Inventors: Loic Bonnard, Verberie (FR); Dominique Costaz, Verberie (FR); Julien Viard, Verberie (FR)

(73) Assignee: POCLAIN HYDRAULICS INDUSTRIE, Verberie (FR)

( * ) Notice: Subject to any disclaimer, the term of this patent is extended or adjusted under 35 U.S.C. 154(b) by 483 days.

(21) Appl. No.: 15/336,352

(22) Filed: Oct. 27, 2016

(65) Prior Publication Data

US 2017/0122285 A1 May 4, 2017

(30) Foreign Application Priority Data

Oct. 29, 2015 (FR) ..... 15 60347

(51) Int. Cl.
*F04B 1/107* (2020.01)
*F03C 1/047* (2006.01)
(Continued)

(52) U.S. Cl.
CPC ..... *F04B 1/107* (2013.01); *F03C 1/047* (2013.01); *F03C 1/0438* (2013.01);
(Continued)

(58) Field of Classification Search
CPC ..... F04B 1/10; F04B 1/063; F04B 1/0452; F04B 1/0456; F04B 1/107; F04B 1/2064;
(Continued)

(56) References Cited

U.S. PATENT DOCUMENTS 6,318,235 B1 * 11/2001 Allart ..... F03C 1/045 60/468
2012/0255294 A1 * 10/2012 Heren ..... F16H 61/4052 60/487

FOREIGN PATENT DOCUMENTS

DE 44 32 479 A1 3/1995
FR 2 673 684 A1 9/1992
WO WO 2011/048327 4/2011

* cited by examiner

*Primary Examiner* — Patrick Hamo
*Assistant Examiner* — Chirag Jariwala
(74) *Attorney, Agent, or Firm* — The Webb Law Firm

(57) ABSTRACT

The machine comprises distribution ducts connected to respective ones of first, second, and third enclosures (40, 42, 44), and a cylinder-capacity selector (21) suitable for being caused to take up a large cylinder capacity configuration in which the second enclosure (42) is connected to one of the main ducts (2), while the first and third enclosures (40, 44) are connected to the other main duct (1), and a small cylinder capacity configuration in which the second and third enclosures (42, 44) are connected to said one of the main ducts (2), while the first enclosure is connected to the other main duct (1). The machine further comprises a safety valve (150) having at least a first port (56) connected to said one of the main ducts (2), and a second port (58) connected to the third enclosure (44). Said safety valve is suitable, when the cylinder-capacity selector (21) is caused to go into the large cylinder capacity, for being caused to go into a first configuration that isolates the first and second ports (56, 58) from each other, and, when the cylinder-capacity selector is caused to go into its small cylinder capacity, for being caused to go into a second configuration that interconnects the first and second ports (56, 58).

13 Claims, 9 Drawing Sheets

(51) Int. Cl.

| | |
|---|---|
| ***F04B 49/10*** | (2006.01) |
| ***F04B 1/0456*** | (2020.01) |
| ***F04B 1/063*** | (2020.01) |
| ***F03C 1/36*** | (2006.01) |
| ***F03C 1/40*** | (2006.01) |

(52) U.S. Cl.
CPC ..... *F03C 1/0447* (2013.01); *F04B 1/0456* (2013.01); *F04B 1/063* (2013.01); *F04B 49/10* (2013.01)

(58) Field of Classification Search
CPC ..... F04B 1/2035; F04B 1/22; F04B 49/10; F03C 1/0438; F03C 1/047; F03C 1/045; F03C 1/0457; F03C 1/0415; F03C 1/0472; F03C 1/0447; F16K 11/10; F16H 61/42
See application file for complete search history.

HYDRAULIC MACHINE HAVING TWO CYLINDER CAPACITIES AND A SAFETY VALVE

This patent application claims the benefit of priority under 35 U.S.C. § 119 to French Patent Application No. 1560347, filed on Oct. 29, 2015, the entirety of which is incorporated herein by reference.

The present description relates to a hydraulic machine having at least two active operating cylinder capacities and suitable for being connected to two main ducts, respectively a main feed duct and a main discharge duct, the machine comprising:

two series of distribution ducts, each of which has first and second groups of distribution ducts, the first group of distribution ducts of the first series being connected to a first enclosure, the second groups of distribution ducts of the first and second series being connected to a second enclosure, and the first group of distribution ducts of the second series being connected to a third enclosure; and a cylinder-capacity selector suitable for being caused to take up a large cylinder capacity configuration in which the second enclosure is connected to one of the main ducts, while the first and third enclosures are connected to the other main duct, and a small cylinder capacity configuration in which the second and third enclosures are connected to one of the main ducts, while the first enclosure is connected to the other main duct.

The first and second series of distribution ducts define respective first and second sub-machines. In the large cylinder capacity, both of the sub-machines are active because each of them has one of its two groups of distribution ducts connected to the feed and the other of its two groups of distribution ducts connected to the discharge. In the small cylinder capacity, only the first sub-machine is active, since both of the groups of distribution ducts of the second series, i.e. of the second sub-machine are connected to the same main duct.

A hydraulic machine of this type, which is, in this example, a hydraulic motor, is known from Document FR 2 673 684.

To change the cylinder capacity of the motor, the cylinder-capacity selector must be caused to go from one of the above-mentioned configurations to the other of said configurations. In general, the cylinder-capacity selector comprises a slide that moves between a first position corresponding to the large cylinder capacity configuration, in which it interconnects the first and third enclosures while isolating them from the second enclosure, and a second position that corresponds to the small cylinder capacity configuration and in which it interconnects the second and third enclosures while isolating them from the first enclosure. Thus, depending on the configuration of the cylinder-capacity selector, i.e. in particular depending on the position of the slide of said selector, the third enclosure is connected either to the first enclosure, or to the second enclosure. However, it can happen that, while it is going over from one configuration to the other, the cylinder-capacity selector jams so that the third enclosure is then isolated both from the first enclosure and from the second enclosure. If the machine operates in such a jammed situation, the pressure in the third enclosure might rise, under the effect of the fluid that is delivered into said enclosure and that can no longer escape from it due to the isolation of said enclosure.

In addition, as indicated above, in the small cylinder capacity configuration, the second and third enclosures are connected to one of the main ducts, while the first enclosure is connected to the other of the main ducts. Thus, the hydraulic machine has a preferred operating direction in the small cylinder capacity, because all of the distribution ducts of the second series are then connected to the same main duct via the interconnection between the second and third enclosures. If this machine is a motor, this preferred direction in the small cylinder capacity corresponds to the direction in which the main duct to which the first enclosure is connected in the small cylinder capacity configuration is a main feed duct. In this situation, all of the distribution ducts in the second series are connected to the discharge duct via the interconnection between the second and third enclosures. Conversely, in the inverse direction, all of the distribution ducts in the second series are connected to the feed in the small cylinder capacity configuration so that the sub-motor corresponding to said second series of distribution ducts is inactivated because all of its distribution ducts are put at the same pressure, but it can exert resistive torque on the motor. In addition, depending on the configuration of the cylinder-capacity selector, the high pressure in the second and third enclosures can cause the selector to move partially, going as far as to isolate the third enclosure from the first and second enclosures, and possibly thereby leading to a large increase in pressure in said third enclosure because the fluid that is delivered into it can no longer escape from it.

To prevent the increase in pressure in the third enclosure from causing damage to the machine, it is possible to choose to connect a pressure limiter to said third enclosure. In a manner known per se, a pressure limiter is a valve rated for a given trigger pressure, as from which it opens so as to connect the enclosure that it protects to removal means, in particular to a pressure-free reservoir.

However, pressure limiters are valves that are costly and relatively voluminous. In addition, the more the machine is designed to withstand high pressures and high flow rates, the higher the cost and the volume of the pressure limiters serving to protect it from excess pressures.

Therefore, in a first aspect, an object of the invention is to improve the state of the art while avoiding as much as possible damaging the machine under the effect of excess pressures, in particular in the third enclosure, by means of a solution that is substantially free of the above-mentioned drawbacks.

Thus, in one aspect, the invention provides a hydraulic machine having at least two active operating cylinder capacities and suitable for being connected to two main ducts, respectively a main feed duct and a main discharge duct, the machine comprising:

two series of distribution ducts, each of which has first and second groups of distribution ducts, the first group of distribution ducts of the first series being connected to a first enclosure, the second groups of distribution ducts of the first and second series being connected to a second enclosure, and the first group of distribution ducts of the second series being connected to a third enclosure; and a cylinder-capacity selector suitable for being caused to take up a large cylinder capacity configuration in which the second enclosure is connected to one of the main ducts, while the first and third enclosures are connected to the other main duct, and a small cylinder capacity configuration in which the second and third enclosures are connected to said one of the main ducts, while the first enclosure is connected to said other main duct;

the machine further comprises a safety valve having at least a first port connected to said one of the main ducts, and a second port connected to the third enclosure, said safety valve being suitable, when the cylinder-capacity selector is caused to go into the large cylinder capacity configuration, for being caused to go into a first configuration in which the first and second ports are isolated from each other, and, when the cylinder-capacity selector is caused to go into its small cylinder capacity configuration, for being caused to go into a second configuration in which the first and second ports are interconnected.

Thus, the safety valve is merely a valve that can be caused to go between the above-mentioned first and second configurations, without having to be rated for any particular pressure. Thus, this valve is both significantly less costly and also significantly less voluminous than a pressure limiter.

And yet the safety valve avoids dangerous excess pressures that can occur when the cylinder-capacity selector is cased to go to the small cylinder capacity configuration when it is in a particular situation in which the machine is operating in the non-preferred direction and in small cylinder capacity, or in which, although it is operating in the preferred direction and in small cylinder capacity, the feed pressure becomes greater than the discharge pressure (in particular through a phenomenon of hydrodynamic braking, such as when the machine is a motor for propelling a vehicle that is traveling forwards and downhill), or indeed in which the selector jams partially while going over from the large cylinder capacity to the small cylinder capacity. Whenever the cylinder-capacity selector is caused to go into its small cylinder capacity configuration, the safety valve connects the third enclosure to the main duct to which its first port is connected, thereby, even in the above-mentioned particular situations, preventing said third enclosure from being isolated and thus preventing excessive pressures in said third enclosure.

Optionally, the safety valve also has a third port connected to said other main duct, and the second and third ports are interconnected when said safety valve is in the first configuration.

Therefore, the second port, and thus the third port, is connected to one or the other of the main ducts depending on whether the cylinder-capacity selector is caused to go into its small cylinder capacity configuration or into its large cylinder capacity configuration. Thus, if, in addition to the situations mentioned above, the cylinder-capacity selector jams while it is being caused to go into its large cylinder capacity configuration from its small cylinder capacity configuration, the third enclosure is not isolated because it is connected to said other main duct. In addition, this is consistent with the fact that, in the large cylinder capacity, the third enclosure should in any event be connected to said other main duct via the cylinder-capacity selector if said selector is operating normally.

Optionally, said one of the main ducts to which the first port of the safety valve is connected is the main duct that serves as the discharge duct when the machine is operating in its preferred operating direction.

Optionally, when the safety valve is in the second configuration, the first and second ports are connected to said one of the main ducts via a check valve allowing fluid to flow only in the direction going from the second port to the first port.

In this situation, it is when the pressure at the second port, i.e. in the third enclosure becomes greater than the pressure at the first port, i.e. in said one of the main ducts, that the fluid flows from the third enclosure. Thus, when said main duct serves as the feed (e.g. in the small cylinder capacity and in the non-preferred operating direction), the interconnection between the first port and the second port of the safety valve does not cause the feed pressure to decrease.

For example, the check valve may then be situated between the first port and said one of the main ducts, and the first port is then continuously connected to said one of the main ducts via said check valve.

Optionally, the cylinder-capacity selector is controlled hydraulically and comprises a selection control chamber connected to a cylinder capacity control duct for urging it to go from one of the configurations, namely the large cylinder capacity configuration or the small cylinder capacity configuration, to the other of said configurations, and an inverse cylinder capacity control suitable for urging it to go from said other of said configurations, namely the large cylinder capacity configuration or the small cylinder capacity configuration, to said one of said configurations.

The inverse cylinder capacity control may comprise another hydraulic control chamber, connected to another control duct, or indeed some other means, in particular return means, such as a spring opposing the effect of the control chamber being fed.

Optionally, the safety valve is controlled hydraulically, and comprises a safety control chamber connected to a safety control duct for urging it to go from one of the first and second configurations to the other of the first and second configurations, and an inverse safety control for urging it to go from said other of the first and second configurations to said one of the first and second configurations.

The inverse safety control may comprise another safety control chamber, connected to another control duct so as to have an effect opposing the effect of the above-mentioned safety control chamber, or indeed return means such as a spring having an effect opposing the effect of the safety control chamber being fed with fluid.

Optionally, the cylinder capacity control duct and the safety control duct are interconnected.

Thus, the cylinder-capacity selector and the safety valve are controlled naturally under the same conditions, in synchronized manner.

Optionally, the machine further comprises an internal fluid distributor comprising the two series of distribution ducts.

Optionally, the cylinder-capacity selector is disposed in the internal fluid distributor.

Thus, the casing portion of the internal distributor may be of standard type or of almost standard type, adapted for several different machines, while the internal fluid distributor and its cylinder-capacity selector are specifically designed for a given machine.

Optionally, the cylinder-capacity selector comprises a slide mounted to move in a bore of the internal fluid distributor, and the first, second, and third enclosures comprise respective ones of first, second, and third grooves in said bore.

Optionally, the safety valve is disposed in a casing portion of the internal distributor.

As indicated above, the safety valve is a valve that is very simple and of small dimensions, and it can thus be easily incorporated into a standard or almost-standard casing portion of the internal distributor.

The invention can be well understood and its advantages appear more clearly on reading the following detailed description of embodiments that are shown by way of non-limiting example. The description refers to the accompanying drawings, in which.

Figure 1:
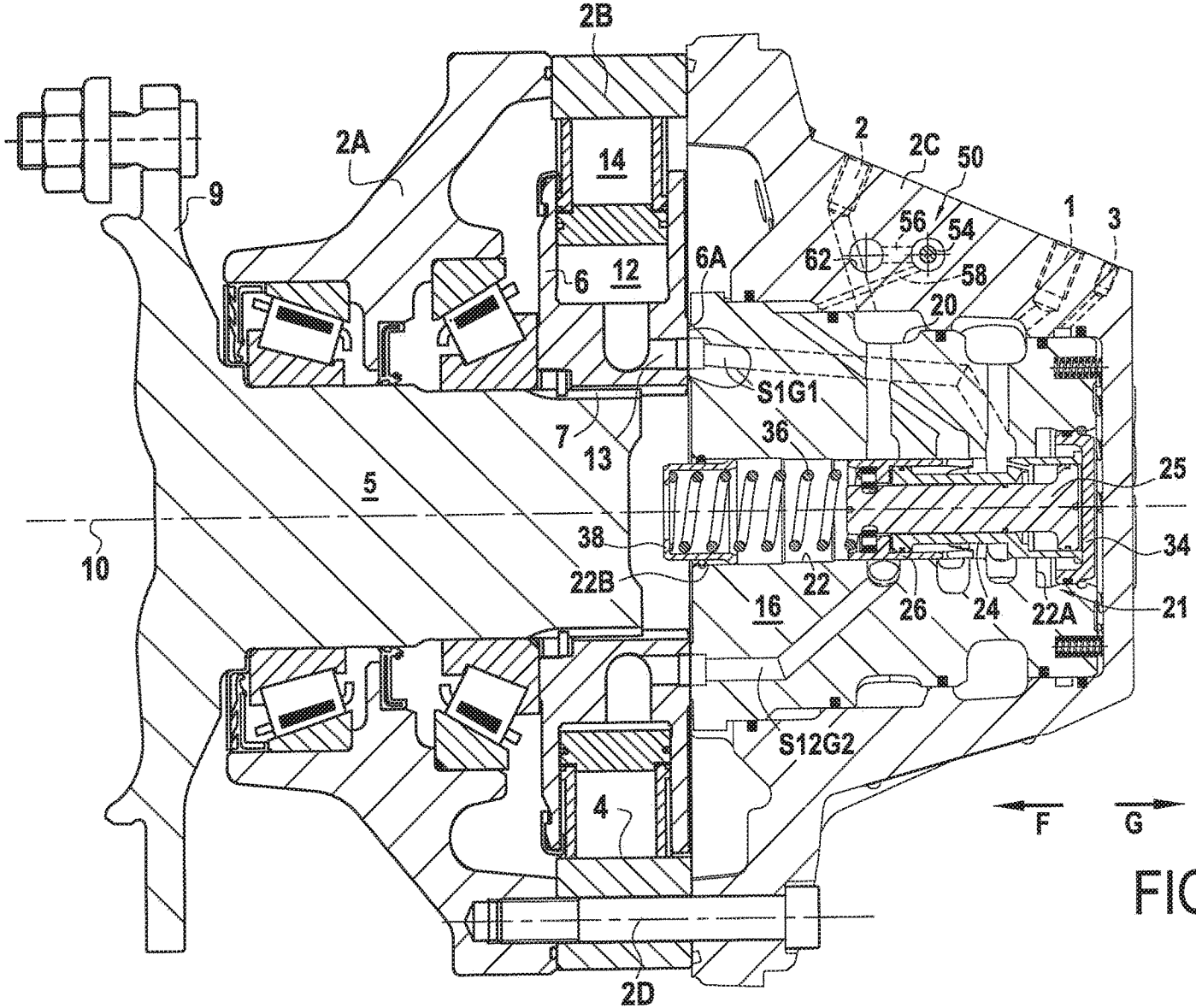
FIG. 1 is an axial section view of a hydraulic machine of the invention, showing the cylinder-capacity selector in the large cylinder capacity configuration.

The hydraulic machine shown in FIG. 1 is of the type having a stationary casing and a rotary cylinder block. However, it is understood that the invention could also apply to a hydraulic machine of the type having a rotary casing and a stationary cylinder block. In the example shown, the machine, which is a motor or a pump, is of the type having radial pistons.

This machine comprises a stationary casing in three portions 2A, 2B, and 2C, assembled together by bolts 2D. An undulating reaction cam 4 is formed in the portion 2B of the casing. The machine further comprises a cylinder block 6 that is mounted to rotate about an axis 10 relative to the cam 4, and that has a plurality of radial cylinders 12 suitable for being fed with fluid under pressure, and inside which the radial pistons 14 are mounted to slide. In this example, the cylinder block 6 drives a shaft 5 in rotation, which shaft 5 co-operates with fluting 7. This shaft carries an outlet flange 9.

The machine further comprises an internal fluid distributor 16 that is secured to the casing so that it is prevented from moving in rotation relative to the casing about the axis 10. In other words, the internal distributor and the cam do not rotate relative to each other. The internal distributor 16 is received inside the casing portion 2C, which may also be referred to as the "distribution cover". This portion 2C may be a block that is bell-shaped, or be closed at its axial end that is opposite from the cylinder block by a separate plate mounted on it.

Figure 2:
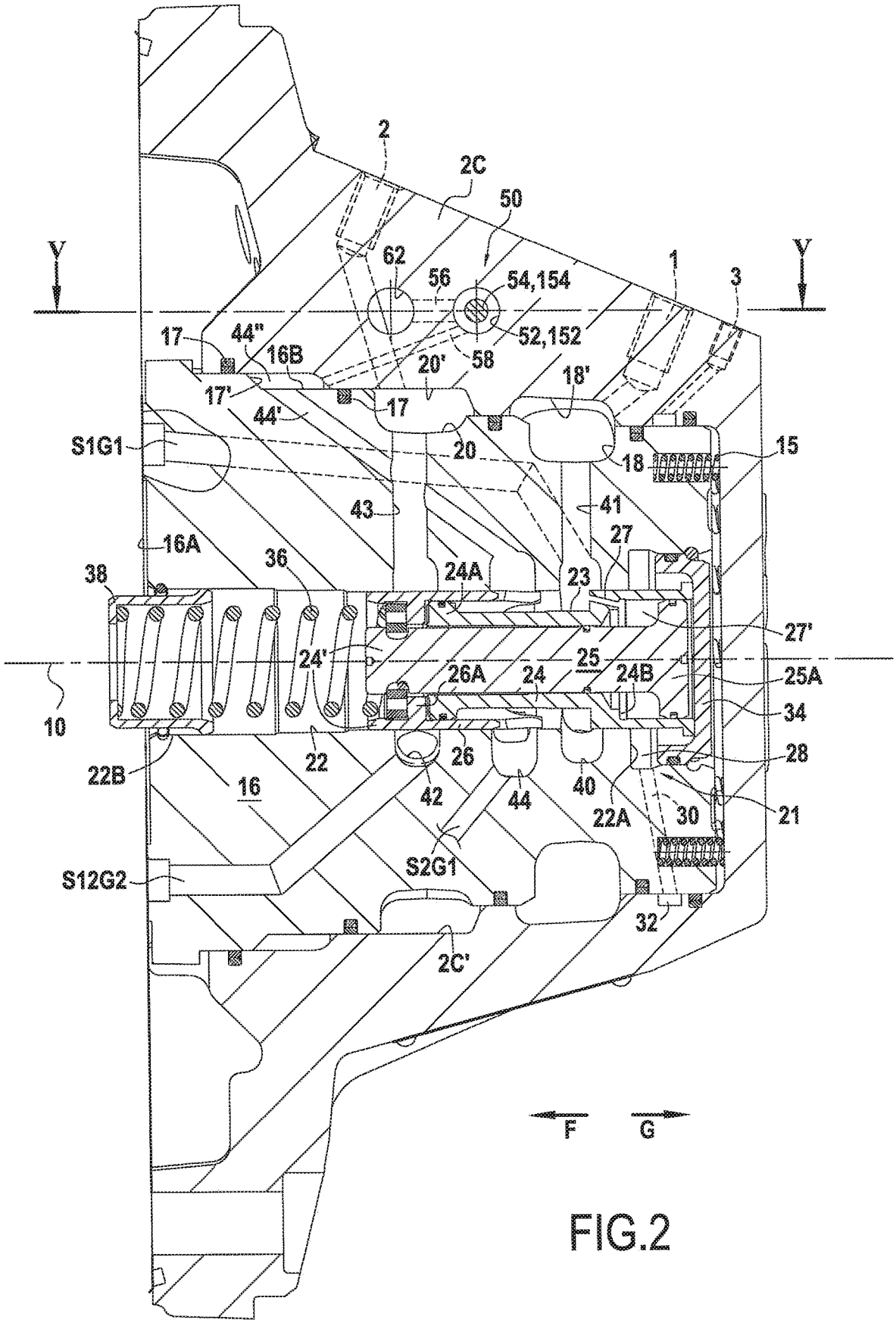
FIG. 2 is an enlargement of the distribution portion of the machine of FIG. 1, in which portion the cylinder-capacity selector and the safety valve are situated.

Also with reference to FIG. 2, which shows the portion of the machine that includes the internal distributor 16 and its distribution cover 2C, it can be seen that the internal distributor has a radial distribution face 16A in which the distribution ducts, such as the ducts S1G1 and S12G2 open out. The internal distributor 16 also has an outer axially-extending face 16B that is provided with a first main groove 18 and with a second main groove 20 that serve respectively as a fluid feed and as a fluid discharge or vice versa. It is considered below that, when the machine is operating in the preferred operating direction, the groove 18 is a feed groove and the groove 20 is a discharge groove. The inner axially-extending face 2C' of the distribution cover 2C that co-operates with the above-mentioned face 16B, is provided with main grooves 18', 20' facing respective ones of the groove 18 and 20. These grooves 18' and 20' communicate with main feed or discharge ducts, respectively 1 and 2, which are bored in the wall of the distribution cover 2C.

The machine further comprises a cylinder-capacity selector 21 provided with an axial bore 22 formed in the internal distributor 16. In this example, this axial bore is centered on the axis 10. The cylinder-capacity selector also includes a main slide 24 that is mounted to move axially in the bore 22 and a secondary slide 24' that has an internal piston 25 disposed inside the main slide 24, and an outside skirt 26, secured to the piston and forming a covering extending back around the end 24A of the main slide 24.

Figure 3:
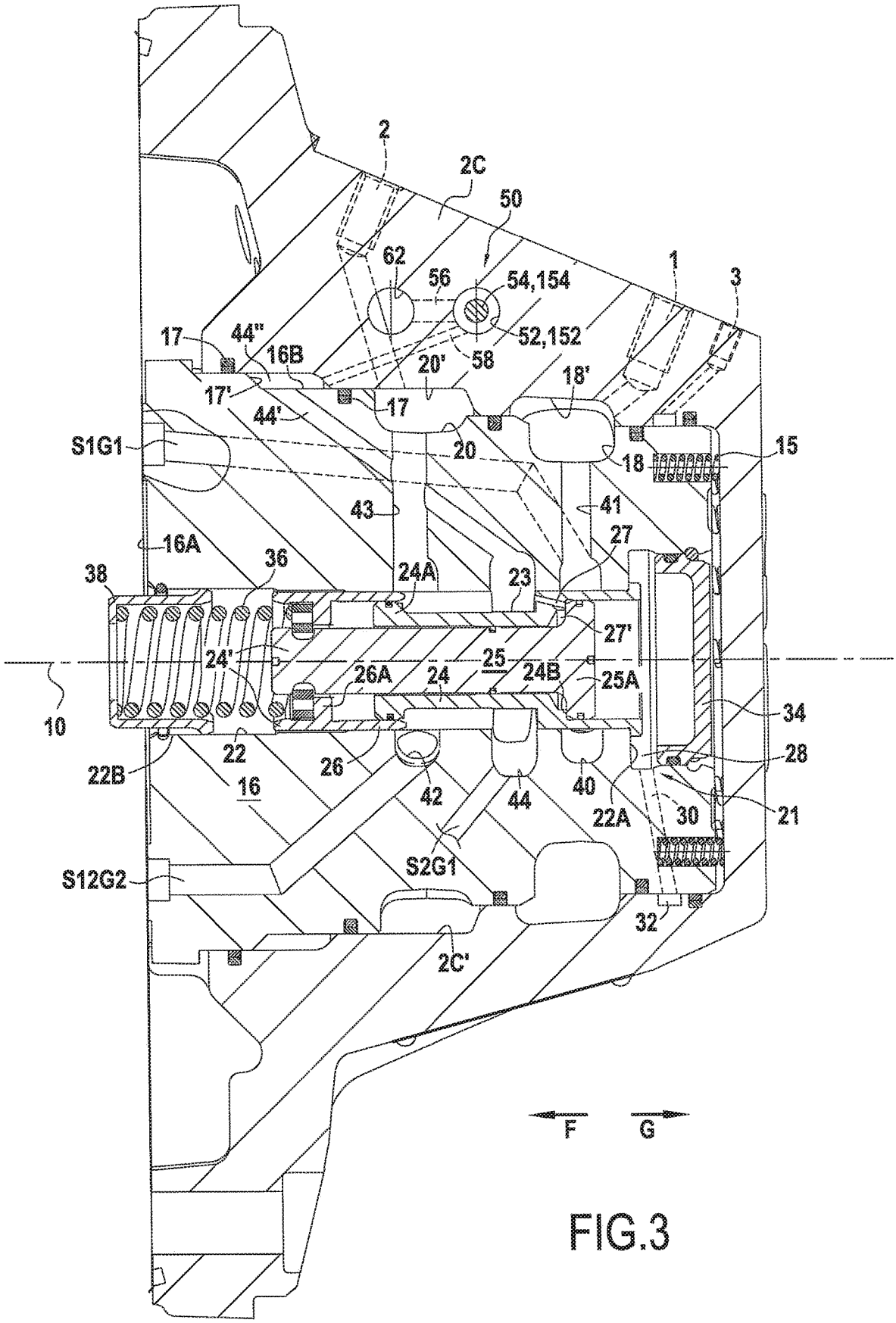
FIG. 3 is a view similar to FIG. 2, showing the cylinder-capacity selector in the small cylinder capacity configuration.
Figure 4:
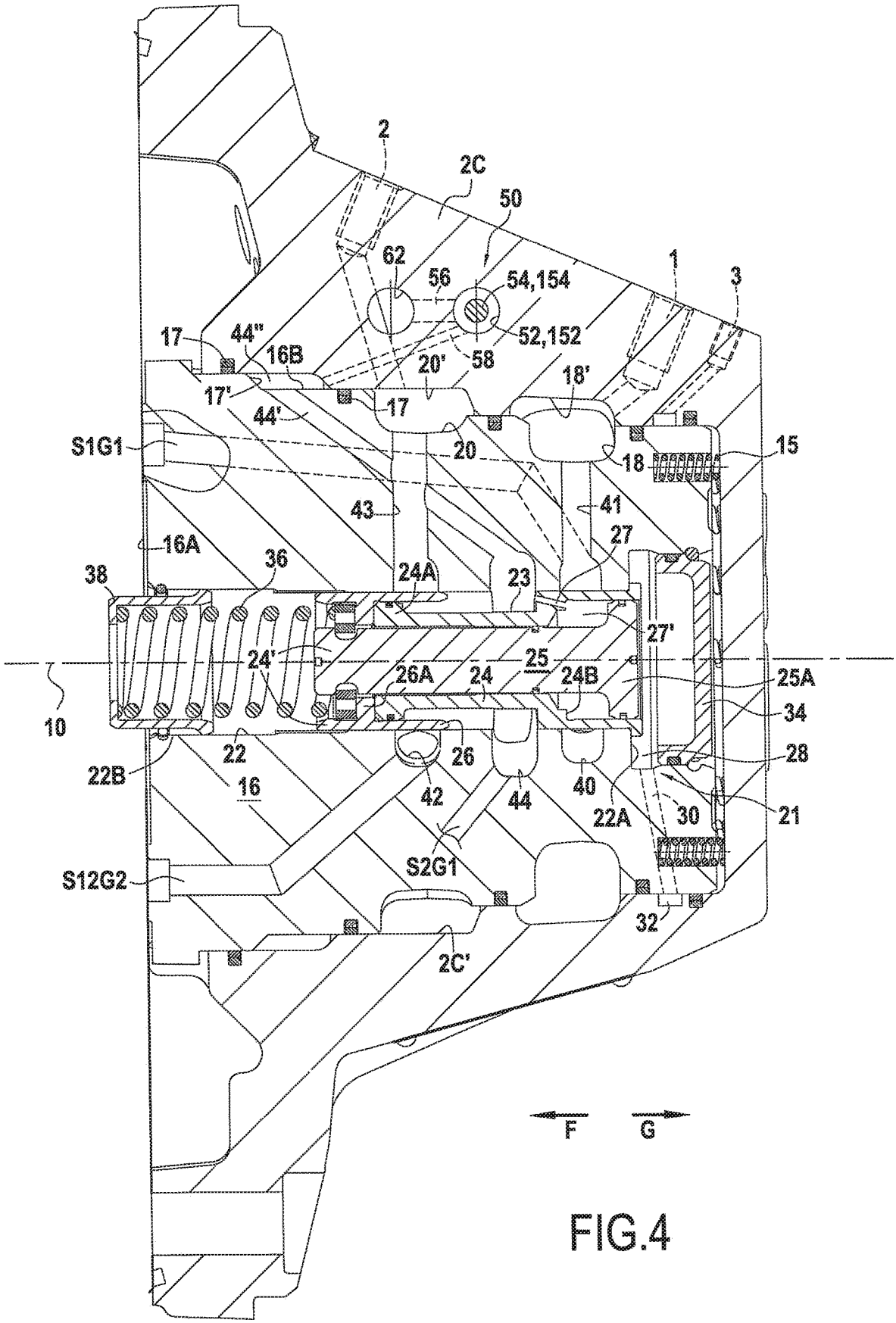
FIG. 4 is a view analogous to FIGS. 2 and 3, showing the cylinder-capacity selector in an intermediate configuration that can generate excessive pressure in the third enclosure.

The cylinder-capacity selector 21 is hydraulically controlled and includes a selection control chamber 28 connected to a cylinder capacity control duct 30 that is shown in dashed lines in FIGS. 2 to 4. In this example, said cylinder capacity control duct 30 is formed by a hole in the internal distributor 16, which hole connects the chamber 28, formed at the end 22A of the bore 22 that is opposite from the cylinder block, to a buffer groove 32 formed in the inner axially-extending periphery 2C' of the distribution cover, this groove 32 being connected to a control hole 3 in the distribution cover. At its end opposite from the main slide 24, the control chamber 28 is closed, in this example by a cover 34 retained at the end 22A of the bore, e.g. by a circlip or by any other means. In the example shown, the bore 22 passes axially through the internal distributor 16 from end to end, and the end-wall of the chamber 28 is thus formed by the separate cover 34. Naturally, it is conceivable for the bore not to be a through bore, and for the end-wall of the control chamber to be formed by a portion of the uninterrupted wall of the internal distributor 16.

It can be understood that the selection control chamber 28 being fed with fluid tends to move the slides 24 and 24' of the cylinder-capacity selector in the axial direction F indicated in FIG. 2.

At the opposite end of the bore 22, i.e. at its end 22B situated in the vicinity of the cylinder block, a return spring 36 is disposed, the effect of which spring opposes the effect of the chamber 28 being filled with fluid. Said spring 26 bears at one end against a shoulder of the skirt 26 or against the piston 25, and, at the other end, against an end cup 38 situated at the end 22B of the bore. The spring tends continuously to push the skirt 26 away in the axial direction G indicated in FIG. 2.

The skirt 26 is secured to the piston 25 via an inside flange 26A that is provided in said skirt, and that is secured to the outside periphery of the piston 25, e.g. via means such as a circlip. The spring 36 thus tends continuously to move the secondary slide assembly 24' formed by the skirt 26 and by the piston 25 in the direction G. In addition, this assembly is mounted to slide axially relative to the slide 24, the piston 25 being mounted to move axially inside said slide and the skirt 26 surrounding the end 24A of said slide.

However, this movement is limited by abutments. The head 25A of the piston 25 that is opposite from the skirt 26 forms a radially-projecting flange suitable for co-operating with a shoulder 24B of the slide 24 so that, while the piston 25 is being moved in the direction F, it also causes the slide 24 to be moved in the same direction F by the flange coming into abutment against said shoulder 24B.

At the opposite end, the secondary slide 24' formed by the piston 25 and by the skirt 26 also has an abutment suitable for coming into abutment with the end 24A of the main slide 24 so that, while the secondary slide 24' is being moved in the direction G, it comes into abutment against said end 24A and thus also moves the main slide 24 in the direction G. In this example, the above-mentioned abutment is formed by the face of the flange 26A of the skirt 26 that is opposite from the spring 36.

Finally, the main slide 24 is provided with a hole 27 that causes the outside periphery of said slide 24 to communicate with the space formed between the shoulder 24B of its inside periphery 24 and the head 25A of the piston 25.

The bore 22 has three grooves, namely a first groove 40 connected to the main groove 18 via a hole 41, a second groove 42 connected to the groove 20 via a hole 43, and a third groove 44 that, in this example, is situated between the grooves 40 and 42. These first, second, and third grooves form respective ones of the first, second, and third enclosures in the meaning of the present description. The various distribution ducts are connected to respective ones of these grooves. Thus, the distribution ducts have two series of distribution ducts, each of which has first and second groups of distribution ducts. The distribution ducts of the first group of distribution ducts of the first series, like the duct S1G1, are connected to the first groove 40. The distribution ducts of the second groups of distribution ducts of the first and second series, like the duct S12G2, are connected to the second groove 42. Finally, the distribution ducts of the first group of distribution ducts of the second series, like the duct S2G1, which is shown in fragmentary manner only in FIGS. 2 to 4, are connected to the third groove 44.

Thus, each of the two series of distribution ducts corresponds to a respective sub-machine. A sub-machine corresponding to a series is active when the first group of ducts of the series and the second group of ducts of the series are put at two different pressures, respectively for feed and for discharge, or vice versa.

Thus, in the configuration shown in FIGS. 1 and 2, the machine is in the large cylinder capacity, with both of the series being active. In this configuration, the first groove 40 and the third groove 44 are interconnected via the interconnection groove 23 of the slide 24 and are thus both connected to the main groove 18, itself connected to the main duct 1, e.g. the feed duct, while the second groove 42 of the bore is isolated from the first groove and from the third groove, and is connected to the main groove 20, e.g. connected to the discharge. In this situation, the first group of ducts of the first series are connected to the main duct 1, while the second group of ducts of the first series are connected to the main duct 2, so that the sub-machine corresponding to said first series is active. At the same time, the first group of ducts of the first series are connected to the main duct 1, while the second group of ducts of the second series are connected to the main duct 2, so that the second sub-machine corresponding to the second series is also active.

Conversely, the configuration shown in FIG. 3 is a small cylinder capacity configuration. In this configuration, the chamber 28 being fed with fluid has pushed the piston 25 away in the direction F and said piston has driven the slide 24 in the same direction F until its end flange 24C comes into abutment against a shoulder situated at the end 22A of the bore. In this situation, the second and third grooves 42 and 44 of the bore 22 communicate with each other via the interconnection groove 23 of the slide 24, while the first groove 40 is isolated from the grooves 42 and 44. In this situation, the first and second groups of distribution ducts of the first series remain connected respectively to the main duct 1 and to the main duct 2. The sub-machine corresponding to the first series of distribution ducts is thus active. Conversely, the two groups of distribution ducts of the second series are connected to the main duct 2 via the interconnection between the grooves 42 and 44, so that the second sub-machine corresponding to the second series is inactive. In this small cylinder capacity configuration and in the preferred operating direction of the machine, in which direction the main duct 2 is a discharge duct, the main slide 24 and the secondary slide 24' formed by the piston 25 and by the skirt 26 are in the position shown in FIG. 3.

However, if the pressure in the main ducts 1 and 2 is inverted, the configuration shown in FIG. 4 is obtained. Such inversion of the pressures in the main ducts 1 and 2 can, for example, be due to the machine operating in reverse, i.e. in the non-preferred operating direction in which the main duct 2 serves as the high-pressure feed while the main duct 1 serves as the discharge. Such pressure inversion may also be due to operation in "motor braking" mode, e.g. when the hydraulic machine is a hydraulic motor for propelling a vehicle that is traveling downhill. In such a situation, the pressure in the main duct 2 that serves as the discharge becomes momentarily higher than the pressure in the main duct 1 that serves as the feed. The cylinder capacity selection control remains active, so that the slide 24 remains in the position shown in FIG. 3. However, the high pressure in the main duct 2 and thus in the groove 42 of the bore 22 feeds, via the hole 27 in the slide 24, the enclosure 27' situated between the shoulder 24B of the slide 24 and the head 25A of the piston 25. The effect of this is to move the secondary slide 24' formed by the piston 25 and by the skirt 26 in the direction G, until the flange 26A of the skirt 26 comes into abutment against the end 24A of the slide 24, i.e. into the position shown in FIG. 4. In this position, the skirt 26 isolates the groove 42 from the groove 44, which groove also remains isolated from the groove 40 by the wall of the main slide 24. Thus, the ducts of the first group of distribution ducts of the second series S2G1, which ducts are connected to the enclosure 44, are isolated from the other distribution ducts. This isolation of the groove 44 or, if the secondary slide 24' is moved only partially in the direction G, the constriction of the interconnection between the grooves 42 and 44 aims in principle to avoid putting the groove 44 at a resistive pressure that is too high and to limit the braking torque delivered during the "motor braking" operating mode, as described in particular in Document WO 2011/048327. However, this situation persists insofar as the fluid delivered into the distribution ducts connected to said groove 44 by the pistons of the machine cannot escape, and the pressure in said ducts and in said groove 44 can, in principle, become very high.

The configuration shown in FIG. 4 may also occur if, when a command is issued to go over from the large cylinder capacity shown in FIGS. 1 and 2 to the small cylinder capacity shown in FIG. 3, the secondary slide 24' formed by the piston 25 and by the skirt 26 is blocked relative to the main slide 24 without being able to move relative to it in the direction indicated by arrow F as desired. In this situation, under the effect of the pressure in the control chamber 28, the slides 24 and 24' go over from the position shown in FIG. 2 to the position shown in FIG. 4, so that the third groove 44 and the distribution ducts of the first group of the second series that are connected to it can be subjected to very high pressures.

To prevent such pressures from damaging the machine, said machine includes a safety valve 50.

Figure 5:
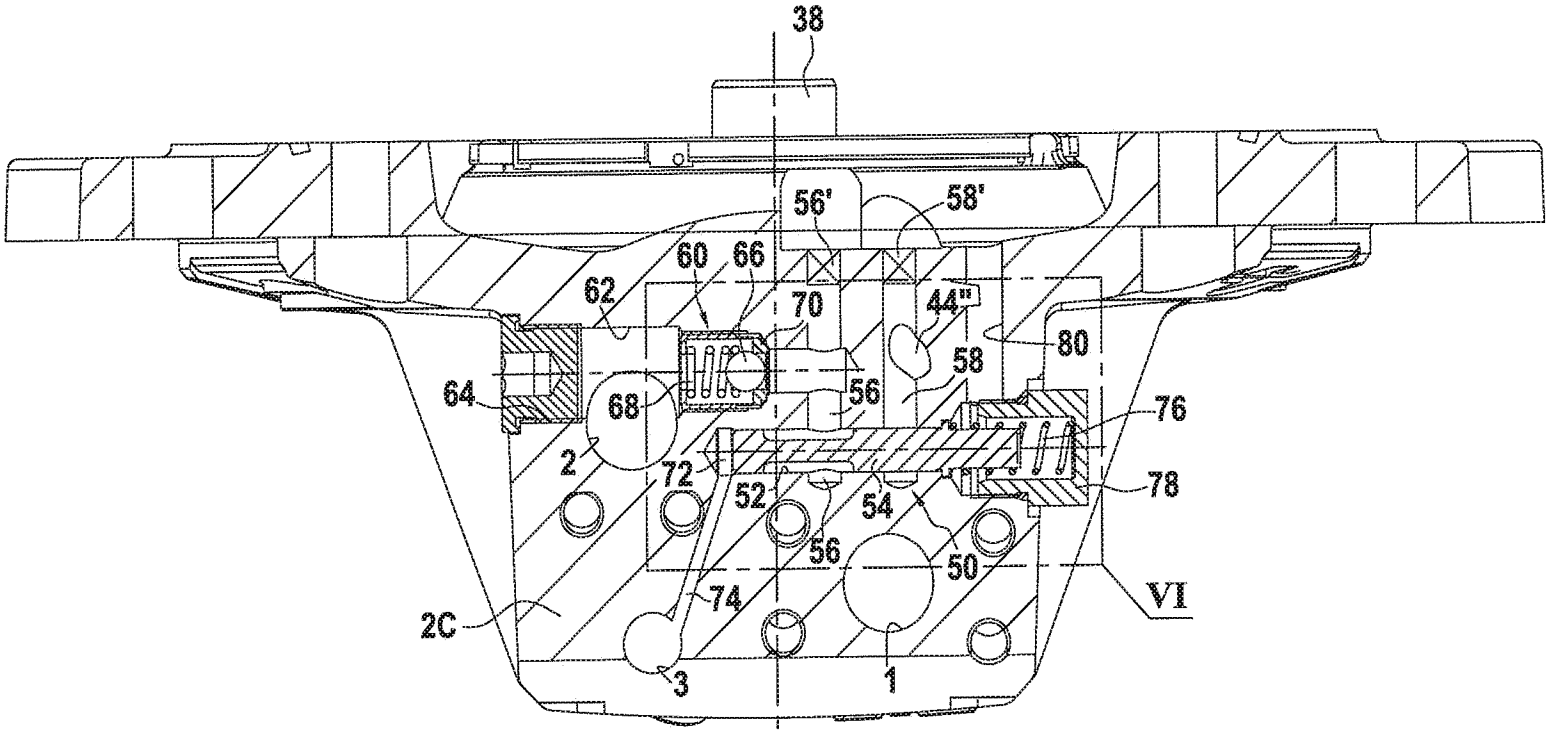
FIG. 5 is a section view on plane V-V of FIG. 2, showing a portion of the machine that is equipped with a first embodiment of a safety valve, this valve being shown in a first configuration.

As can be seen more clearly in FIG. 5, said safety valve 50 includes a bore 52 formed in the distribution cover 2C, and a slide 54 that is mounted to move in said bore. In this example, the bore 52 is formed transversely relative to the axis 10. The safety valve has a first port 56 connected to the main duct 2, and a second port 58 connected to the third groove 44 of the bore 22 of the cylinder-capacity selector. In this example, as can be seen, for example, in FIG. 2, this groove 44 is connected to the outer axially-extending face 16B of the internal distributor 16 via a hole 44' in said distributor. This hole 44' opens out into an enclosure 44" delimited by two gaskets 17 between the outside face 16B and the inside face 2C' of the distribution cover. The hole 44' is shown in full to make the drawing and the explanations referring to it clearer, it being, however, understood that, in reality, it does not intersect the hole 43, these two holes being, for example, in different planes. This enclosure 44" includes a shoulder 17' that forms a thrust and balance surface that, under the effect of the pressure in the enclosure 44", contributes to pushing the radial face 16A of the internal distributor 16 against the communication face 6A (see FIG. 1) of the cylinder block 6 into which the cylinder ducts 13 open out, which cylinder ducts communicate with the distribution ducts while the cylinder block and the cam are moving in rotation relative to each other. In this respect, it should be noted that the grooves 18 and 20 may also have thrust and balance surfaces, and that the machine may be provided with additional thrust and balance means for the internal distributor 16, such as the springs 15 disposed between the end-wall of the distribution cover 2C and the facing face of the internal distributor 16.

As can be seen in FIGS. 2 to 4, the bore 52 of the safety valve communicates with the enclosure 44" via a hole 58 that forms the second port of the safety valve 50. The first port 56 of said valve has a hole that communicates with the main duct 2. In this example, this communication is established via a check valve 60 disposed in a hole 62 connected to the main duct 2. In this example, this hole 62 is formed transversely relative to the axis 10 and is closed by a stopper 64 on the outside face of the distribution cover 2C. In a manner known per se, the check valve is screwed into the end of the hole 62 that is opposite from the stopper 64, and it includes a moving closure member such as a ball 66 urged continuously to return against a seat 70 by a spring 68. Thus, the communication between the main duct 2 and the first port 56 of the safety valve is normally closed, and it opens only when the pressure in the port 56, and thus in the groove 44 in the internal distributor, becomes greater than the pressure in the main duct 2.

In this example, the holes 56 and 58 forming the first and second ports of the safety valve 50 are formed by axial holes that, at their ends opposite from the bore 52, are closed by respective stoppers 56' and 58'.

In this example, the safety valve 50 is controlled hydraulically and includes a safety control chamber 72 connected to a safety control duct 74 to urge the slide 54 to move in the direction I indicated in FIG. 5 when the chamber 72 is fed with fluid. The safety valve 50 also includes an inverse safety control for urging the slide to move in the direction J opposite from the direction I. In this example, this inverse safety control comprises a spring 76 disposed at the end of the bore 52 that is opposite from the safety control chamber 72. In this example, this end is closed by a stopper 78, the spring 76 bearing between the stopper 78 and a shoulder of the slide 54.

FIG. 5 shows the safety valve in a first configuration, in which the first and second ports 56 and 58 are isolated from each other. This first configuration is obtained by the return effect of the spring 76, the safety control chamber 72 then not being fed with fluid, in particular when the cylinder-capacity selector 21 is itself caused to go into its large cylinder capacity configuration.

Figure 6:
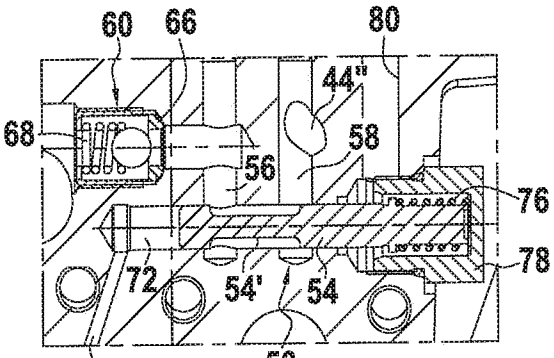
FIG. 6 is a view of the portion VI of FIG. 6, showing the safety valve in its second configuration.

Conversely, in FIG. 6, the chamber 72 is fed with fluid, and it can be seen that the slide 54 has moved in the direction I against the return force of the spring 76, in such a manner as to cause the ports 56 and 58 to communicate via a groove 54' in the slide 54.

In the first configuration, the ports 56 and 58 are isolated, so that the safety valve does not interfere with the communication between the groove 44 of the cylinder-capacity selector and other grooves of said selector. This first configuration is, in particular, obtained when the cylinder-capacity selector is caused to go into its large cylinder capacity configuration shown in FIG. 2, in which the grooves 40 and 44 communicate with each other while the groove 42 is isolated.

The safety valve is caused to go into its second configuration shown in FIG. 6 when the cylinder-capacity selector is caused to go into its small cylinder capacity configuration shown in FIG. 3. In this second configuration, the communication between the ports 56 and 58 causes the third groove 44 of the cylinder-capacity selector to communicate with the main duct 2, via the check valve 60. If, while the safety valve is in this second configuration, the pressure in the groove 44 increases due to the cylinder-capacity selector being positioned in the configuration shown in FIG. 4, this increase in pressure in the groove 44 and thus in the ports 56 and 58 opens the check valve 50 so as to establish communication between the groove 44 and the second main duct 2. In this situation, excess pressure is avoided because the fluid can take on the pressure of the main duct 2.

In FIG. 5, it can be seen that the safety control duct 74 is connected to the control hole 30 described with reference to FIG. 2. As indicated in that description, this hole 30 serves to feed the cylinder capacity control duct 30 of the cylinder-capacity selector, via the buffer groove 32. The control ducts 30 and 74 may merely both be connected to the buffer groove 32, which groove is also fed via the control hole 3.

In FIGS. 5 and 6, it can be seen that the safety valve 50 has a drain duct 80 that is situated at the end of the bore 52 opposite from the safety control chamber 72 and that is connected to the inside space of the casing of the machine.

Figure 7:
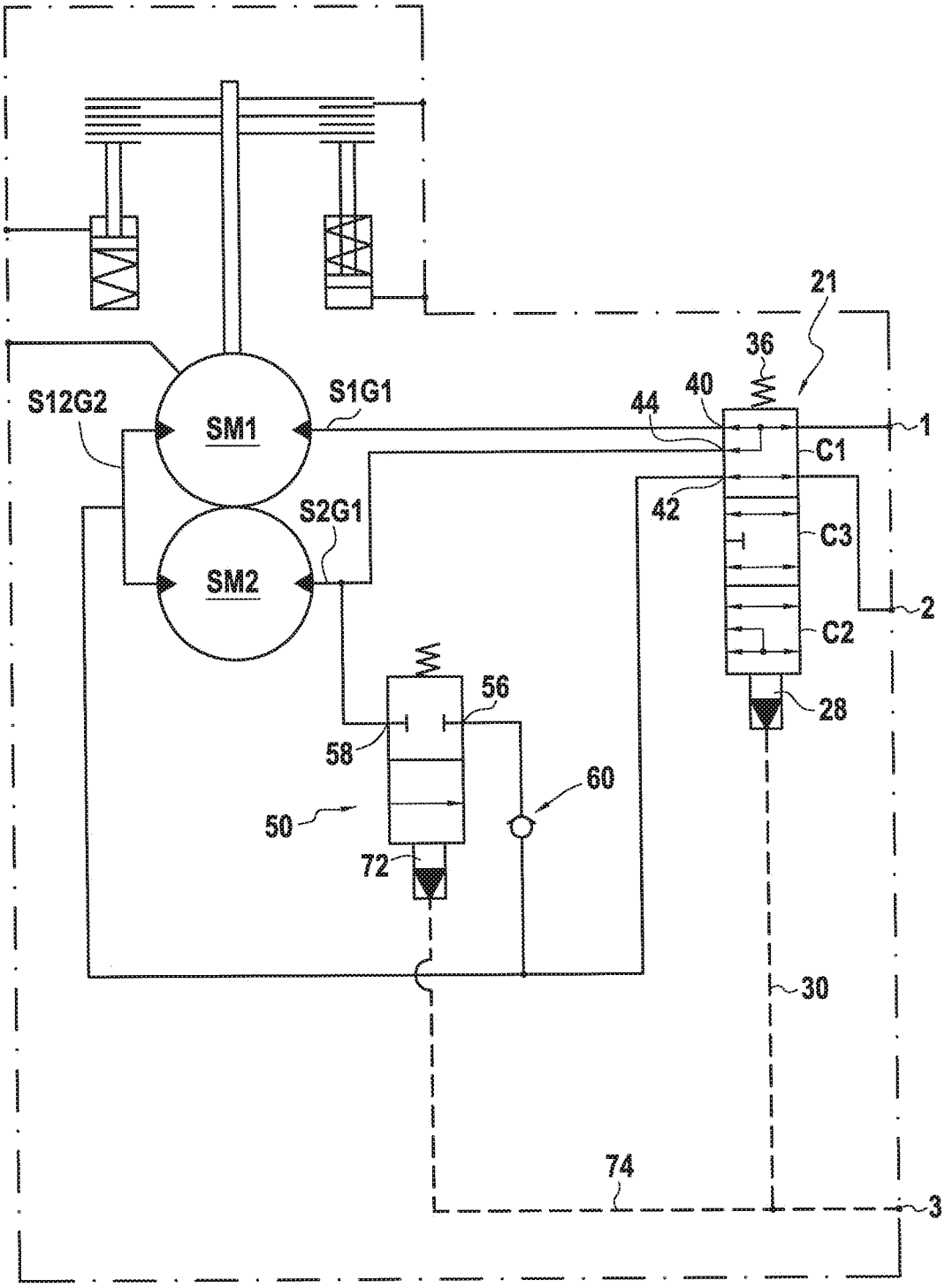
FIG. 7 is a hydraulic circuit diagram of the machine of FIG. 1 as equipped with the first embodiment of the safety valve.

FIG. 7 is a circuit diagram showing how the machine operates with the above-described safety valve 50. This figure diagrammatically shows the two sub-machines SM1 and SM2 corresponding to respective ones of the two series of distribution ducts, the cylinder-capacity selector 21 and the safety valve 50. This figure also shows the distribution ducts S1G1 of the first group of the first series that are connected to the groove 40, the distribution ducts S2G1 of the first group of the second series that are connected to the third groove 44, and the distribution ducts S12G2 of the second groups of the first and second series that are connected to the second groove 42. The first port 56 of the valve 50 is connected to the main duct 2 (in this example, this interconnection is represented by an interconnection between the first port 56 and the second groove 42 that is itself continuously connected to the duct 2 via the cylinder-capacity selector 21), and its second port 58 is connected to the distribution ducts S2G1 connected to the third groove 44. FIG. 7 shows the cylinder-capacity selector 21 in its large cylinder capacity C1, the grooves 40 and 44 being connected to the main duct 1 while the groove 42 is connected to the main duct 2. In this large cylinder capacity configuration, the safety valve 50 is in its first configuration, the ports 56 and 58 being isolated.

The cylinder-capacity selector being caused to go into its small cylinder capacity by the chamber 28 being fed causes, in principle, said cylinder-capacity selector to go into its small cylinder capacity C2, in which only the groove 40 is connected to the main duct 1, while the grooves 42 and 44 are connected to the main duct 2.

However, for the reasons mentioned with reference to FIG. 4, the selector may take up an intermediate configuration C3, in which only the groove 40 is connected to the main duct 1, while only the groove 42 is connected to the main duct 2, and while the groove 44 is isolated. However, the cylinder-capacity selector 21 being caused to go into its small cylinder capacity by the chamber 28 being fed has also caused the safety control chamber 72 to be fed, thereby causing the safety valve 50 to go into its second position in which the first and second ports 56 and 58 communicate with each other, thereby causing the third groove 44 of the cylinder-capacity selector to communicate with the main duct 2 (in this example via the groove 42 connected continuously to said main duct 2), via the check valve 160.

A second embodiment of the safety valve 150 is described below with reference to FIGS. 8 to 10. This valve 150 includes a bore 152 that, in this example, is formed transversely relative to the axis 10 in the distribution cover 2C, and a slide 154 mounted to move in said bore.

In this embodiment, the safety valve 150 has three ports, namely a first port 156 connected to the main duct 2, a second port 158 connected to the groove 44 of the cylinder-capacity selector, and a third port 159 connected to the first main duct 1. The interconnection between the port 158 and the groove 44 may be implemented in a manner identical to the interconnection between the port 56 of the first embodiment of the safety valve and said groove 44. The interconnection between the third port 159 and the first main duct 1 may be direct, via a hole 159' in the distribution cover 2C. The interconnection between the port 156 and the second main duct 2 may be implemented via a check valve 160 shown in FIG. 10. This check valve is disposed in a hole 162 in the distribution cover 2C that is closed by a stopper 164, and includes a moving closure member 166 that is continuously urged by a spring 168 to return against a seat 170. The hole 162 connects the first port 156 of the safety valve to the main duct 2, via the grooves 20 and 20' in the outer axially-extending face of the internal distributor 16 and in the inner axially-extending face of the distribution cover 2C. It can be understood that said check valve 160 opens to connect the port 156 to the second main duct 2 when the pressure in the port 156 becomes higher than the pressure in said main duct. The port 156 is formed by a hole that, in this example, is substantially parallel to the axis 10, and that is closed by a stopper 156' at its end opposite from the bore 152. A drain duct 180 analogous to the duct 80 of FIG. 5 may be provided.

The safety valve 150 is controlled hydraulically and it includes a safety control chamber 172 connected to a safety control duct 174, itself connected to the control hole 3. As in the first embodiment, the safety control duct 174 is thus connected to the cylinder capacity control duct 30 via the buffer groove 32. In this example, the safety control chamber 172 being fed with fluid causes the slide 154 to be moved in the direction I to cause it to go from its first position shown in FIG. 8, corresponding to the safety valve being in its first configuration, to its second position shown in FIG. 9, corresponding to the safety valve being in its second configuration. The safety valve control includes an inverse safety control comprising, in this example, a return spring 176 that tends to push away the slide 154 continuously towards its first position in the direction J. The spring 176 bears at one end against a stopper 178 for closing the bore 152 and, at the other end, against a shoulder of the slide 154.

Figure 8:
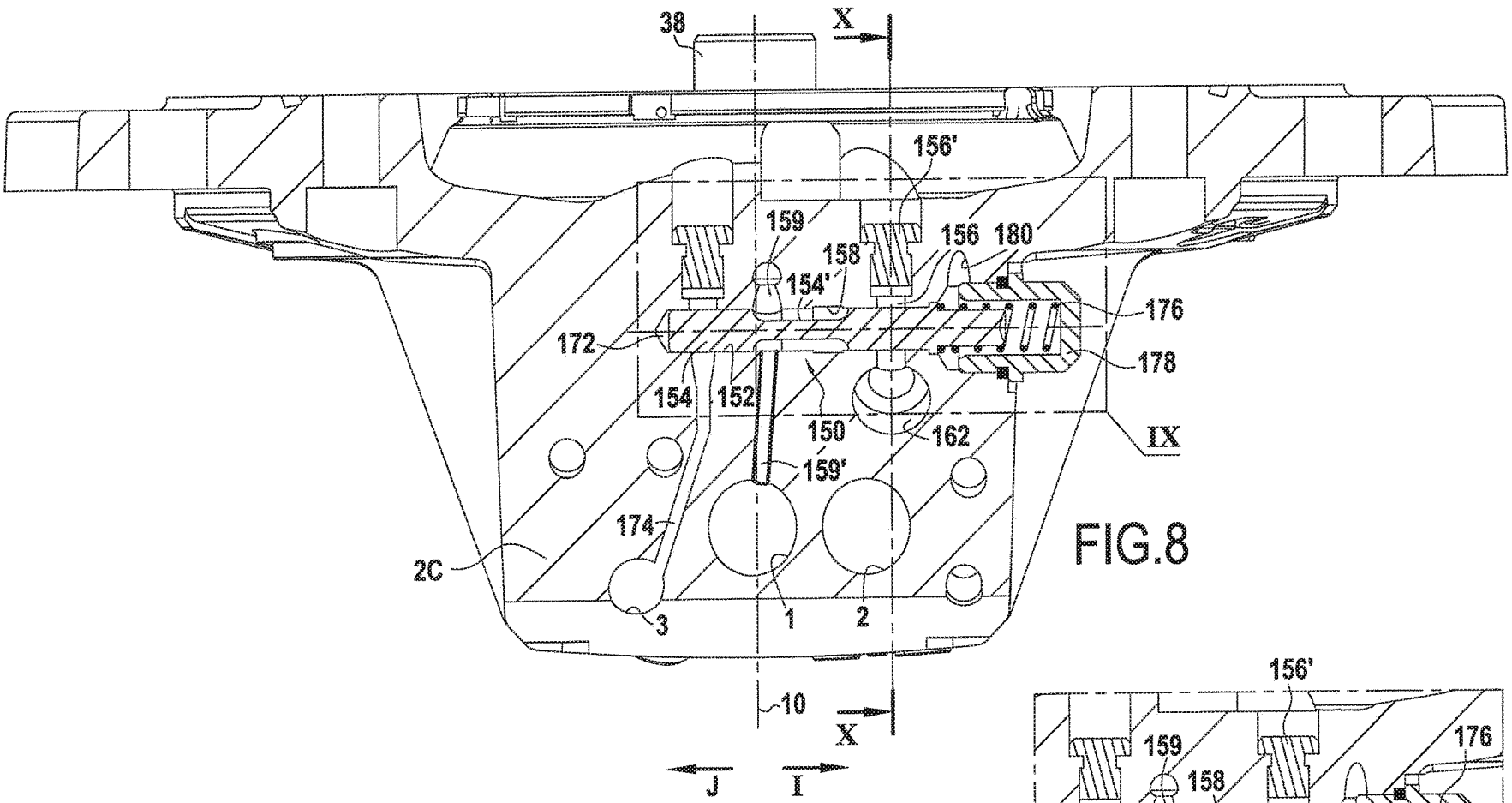
FIGS. 8 and 9 are views analogous to FIGS. 5 and 6, showing a second embodiment of the safety valve.

When the safety valve 150 is in its first configuration shown in FIG. 8, the slide 154 causes the second and third ports 158 and 159 to communicate with each other, via a groove 154' in said slide. Conversely, in this first configuration, the first port 156 is isolated from the ports 158 and 159. This first configuration is obtained by default under the return effect of the spring 176, in particular when the cylinder-capacity selector 21 is caused to go into its large cylinder capacity configuration. In this first configuration, the communication between the ports 158 and 159 contributes to causing the groove 44 of the cylinder-capacity selector to communicate with the groove 40, and this corresponds to the desired situation in the large cylinder capacity configuration.

Figure 9:
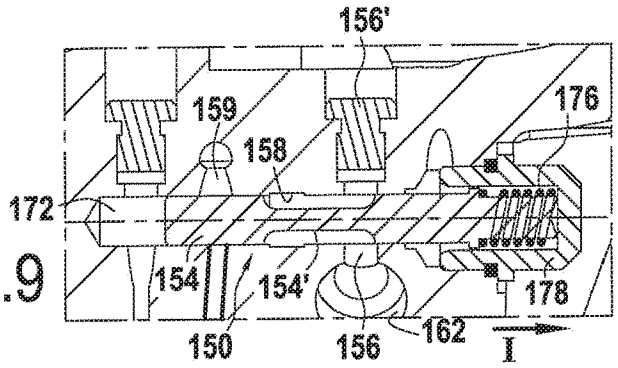
Figure 10:
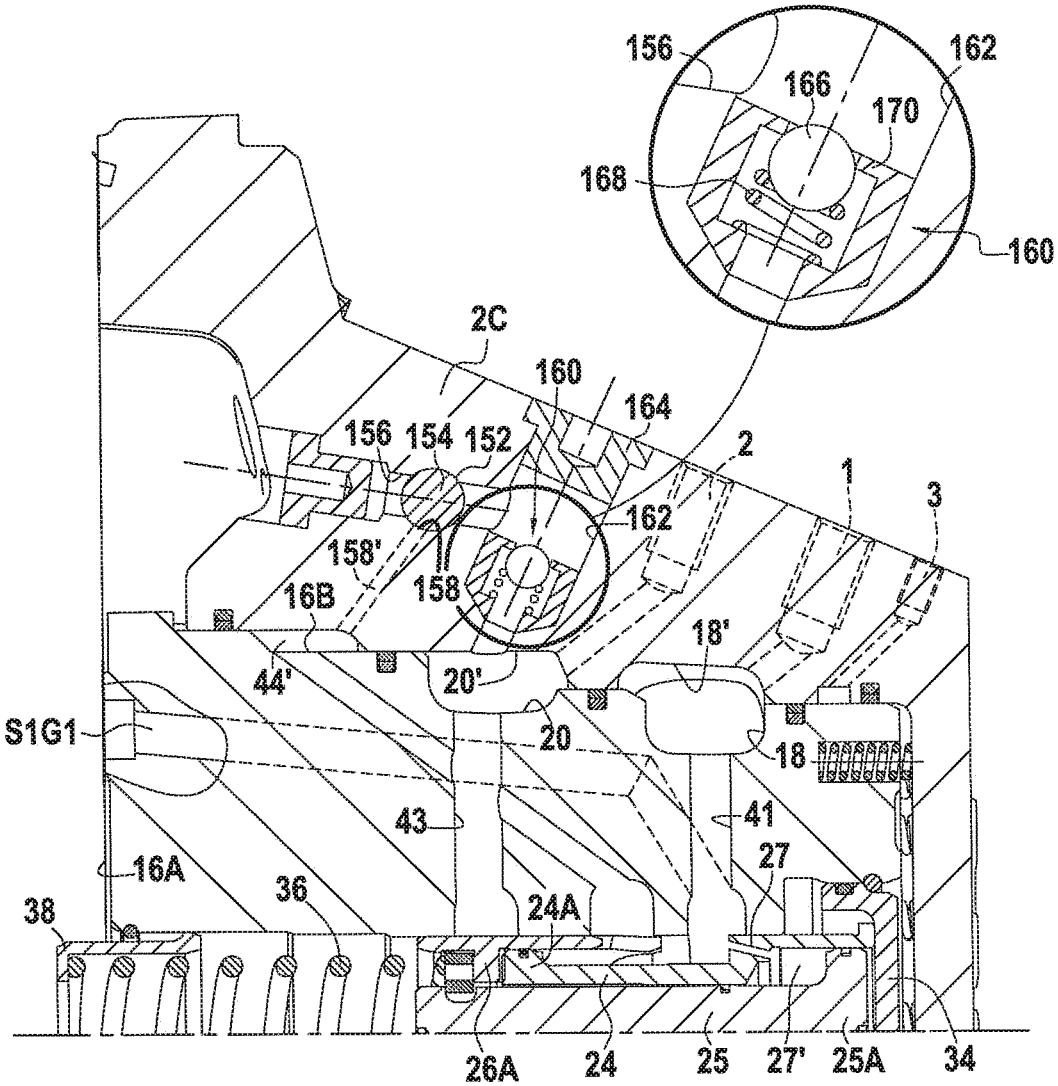
FIG. 10 is a section view on plane X-X of FIG. 8.

In its second configuration shown in FIG. 9, which is a view of the portion IX in FIG. 8, the safety valve 150 causes the first and second ports 156 and 158 to communicate with each other via the groove 154', while the third port 159 is isolated from the ports 156 and 158. Thus, the groove 44 of the cylinder-capacity selector is connected to the second main duct 2, in this example via the check valve 160. Excess pressure in the groove 44 is thus avoided by this communication.

Figure 11:
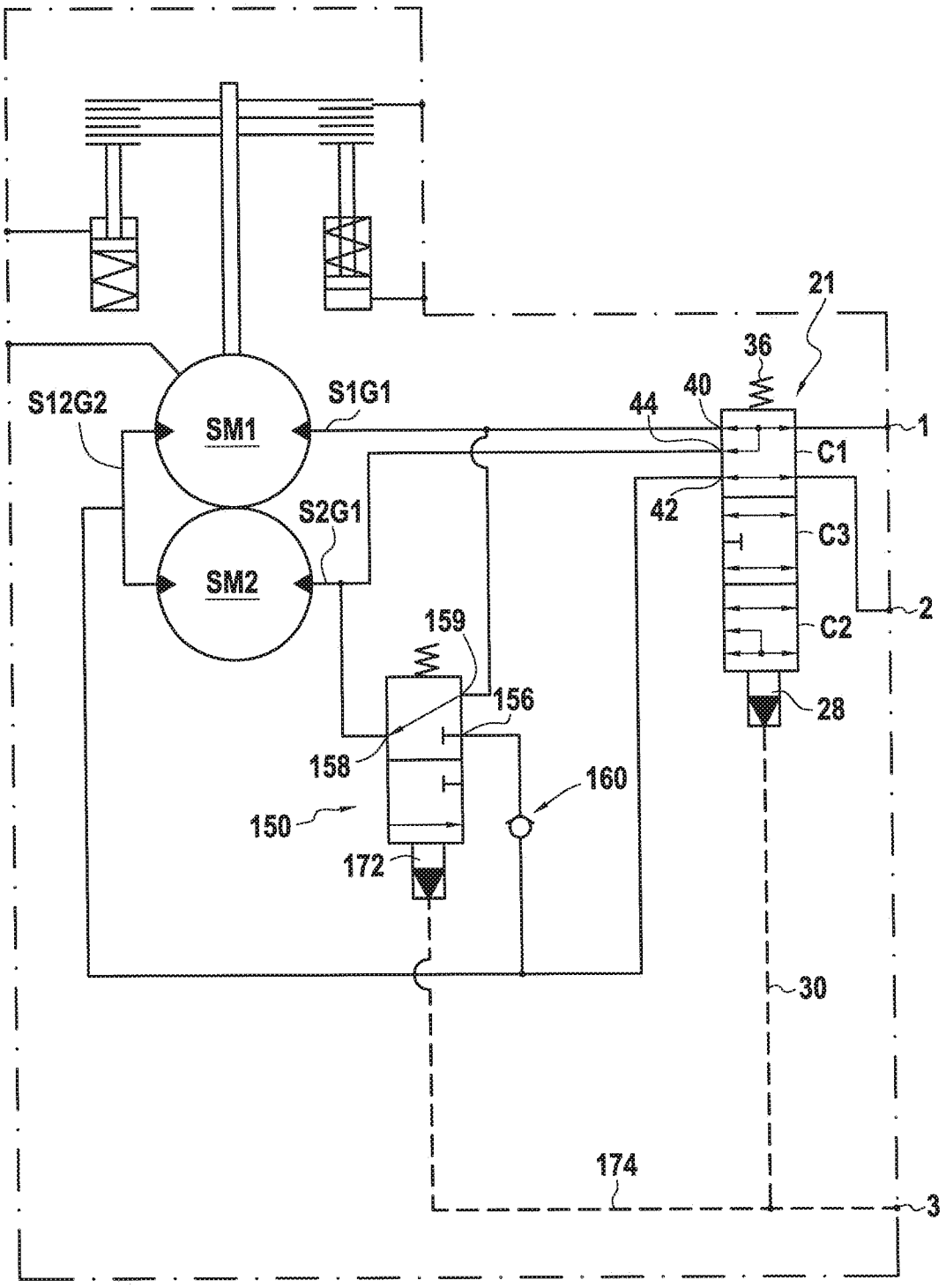
FIG. 11 is a hydraulic circuit diagram of the hydraulic machine of FIG. 1 as equipped with the second embodiment of the safety valve.

The hydraulic circuit diagram of the machine as equipped with the second embodiment of the safety valve is shown in FIG. 11. This figure shows two sub-machines SM1 and SM2 having their distribution ducts S12G2 of the second groups of the first and second series connected to the second groove 42 of the cylinder-capacity selector 21, while the distribution ducts S1G1 of the first group of the first series are connected to the first groove 40, and while the distribution ducts S2G1 of the first group of the second series are connected to the third groove 44.

FIG. 11 shows the situation in which the cylinder-capacity selector is caused to go into its large cylinder capacity C1. The grooves 40 and 44 are thus connected to the first main duct 1, while the groove 42 is connected to the second main duct 2. The safety valve 150 is then in its first configuration, in which its second and third ports 158 and 159 are interconnected and are isolated from the third port 156.

When the cylinder-capacity selector is in its small cylinder capacity configuration C2, only the groove 40 is connected to the main duct 1, while the grooves 42 and 44 are connected to the main duct 2.

However, for the reasons mentioned with reference to FIG. 4, the cylinder-capacity selector may, in spite of said selector being caused to go into its small cylinder capacity configuration, take up the above-mentioned intermediate configuration C3. The cylinder-capacity selector being caused to go into its small cylinder capacity by the chamber 28 being fed has also caused the safety control chamber 172 to be fed, thereby causing the safety valve 150 to go into its second position in which the first and second ports 156 and 158 communicate with each other, while being isolated from the third port 159. Thus, the third groove 44 of the cylinder-capacity selector communicates with the main duct 2 (in this example via the groove 42 connected continuously to said main duct 2), via the check valve 160.

The invention claimed is:

1. A hydraulic machine comprising at least two active operating cylinder capacities and suitable for being connected to two main ducts, respectively a main feed duct and a main discharge duct, the machine comprising:

two series of distribution ducts, each of which has first and second groups of distribution ducts, the first group of distribution ducts of the first series being connected to a first enclosure, the second groups of distribution ducts of the first and second series being connected to a second enclosure, and the first group of distribution ducts of the second series being connected to a third enclosure;

a cylinder-capacity selector suitable for being caused to take up a large cylinder capacity configuration of the at least two active operating cylinder capacities in which the second enclosure is connected to one of the main ducts, while the first and third enclosures are connected to the other main duct, and a small cylinder capacity configuration of the at least two active operating cylinder capacities in which the second and third enclosures are connected to said at least one of the main ducts, while the first enclosure is connected to said other main duct, said large cylinder capacity configuration and small cylinder capacity configuration of the cylinder-capacity selector being different configurations of said cylinder-capacity selector; and a safety valve having at least a first port fluidly connected to said one of the main ducts, and a second port fluidly connected to the third enclosure, said safety valve being suitable, when the cylinder-capacity selector is caused to go into the large cylinder capacity configuration, for being caused to go into a first configuration in which the first and second ports are isolated from each other, and, when the cylinder-capacity selector is caused to go into the small cylinder capacity configuration, for being caused to go into a second configuration in which the first and second ports are interconnected, the first port of the safety valve being fluidly connected to said one of the main ducts in said first and second configurations of the safety valve.

2. The machine as claimed in claim 1, wherein the safety valve also has a third port fluidly connected to said other main duct, and the second and third ports are interconnected when said safety valve is in the first configuration.

3. The machine as claimed in claim 1, wherein said one of the main ducts to which the first port of the safety valve is fluidly connected is the main duct that serves as the discharge duct when the machine is operating in a preferred operating direction thereof.

4. The machine as claimed in claim 1, wherein, when the safety valve is in the second configuration, the first and second ports are fluidly connected to said one of the main ducts via a check valve allowing fluid to flow only in the direction going from the second port to the first port.

5. The machine as claimed in claim 1, wherein, in both the large cylinder capacity configuration and the small cylinder capacity configuration of the cylinder-capacity selector, and in both the first and second configuration of the safety valve, the first group of distribution ducts of the first series are connected to the first enclosure, the second groups of distribution ducts of the first and second series are connected to the second enclosure, and the first group of distribution ducts of the second series are connected to the third enclosure.

6. The machine as claimed in claim 1, wherein the cylinder-capacity selector is controlled hydraulically and comprises a selection control chamber connected to a cylinder capacity control duct for urging said cylinder-capacity selector to go from one of the large cylinder capacity configuration and the small cylinder capacity configuration, to the other of said large cylinder capacity configuration and said small cylinder capacity configuration, and an inverse cylinder capacity control suitable for urging said cylinder-capacity selector to go from said other of said large cylinder capacity configuration and said small cylinder capacity configuration, to said one of said large cylinder capacity configuration and said small cylinder capacity configuration.

7. The machine as claimed in claim 6, wherein the safety valve is controlled hydraulically, and comprises a safety control chamber connected to a safety control duct for urging said safety valve to go from one of the first and second configurations to the other of the first and second configurations, and an inverse safety control for urging said safety valve to go from said other of the first and second configurations to said one of the first and second configurations, the cylinder capacity control duct and the safety control duct are interconnected.

8. The machine as claimed in claim 1, wherein the safety valve is controlled hydraulically, and comprises a safety control chamber connected to a safety control duct for urging said safety valve to go from one of the first and second configurations to the other of the first and second configurations, and an inverse safety control for urging said safety valve to go from said other of the first and second configurations to said one of the first and second configurations.

9. The machine as claimed in claim 8, wherein the safety valve also has a third port fluidly connected to said other main duct, and the second and third ports are interconnected when said safety valve is in the first configuration.

10. The machine as claimed in claim 1, wherein further comprising an internal fluid distributor comprising the two series of distribution ducts.

11. The machine as claimed in claim 10, wherein the safety valve is disposed in a casing portion of the internal distributor.

12. The machine as claimed in claim 10, the cylinder-capacity selector is disposed in the internal fluid distributor.

13. The machine as claimed in claim 12, wherein the cylinder-capacity selector comprises a slide mounted to move in a bore of the internal fluid distributor, and the first, second, and third enclosures comprise respective ones of first, second, and third grooves in said bore.

* * * * *